US006002416A

United States Patent [19]

Gerber

[11] Patent Number: 6,002,416

[45] Date of Patent: Dec. 14, 1999

[54] METHOD AND APPARATUS FOR THERMAL TRANSFER COLOR PRINTING

[75] Inventor: David J. Gerber, Avon, Conn.

[73] Assignee: Gerber Scientific Products, Inc., Manchester, Conn.

[21] Appl. No.: 08/735,923

[22] Filed: Oct. 24, 1996

Related U.S. Application Data

[60] Continuation-in-part of application No. 08/451,005, May 25, 1995, Pat. No. 5,661,515, which is a division of application No. 08/007,662, Jan. 22, 1993, abandoned.

[51] Int. Cl.[6] ..... B41J 2/325

[52] U.S. Cl. ..... 347/176

[58] Field of Search ..... 347/172, 173, 347/174, 175, 176; 400/120.02, 120.03, 120.04; 235/469

[56] References Cited

U.S. PATENT DOCUMENTS

| | | | |
|---|---|---|---|
| 3,835,297 | 9/1974 | Inoue et al. | 235/469 |
| 5,661,515 | 8/1997 | Hevenor et al. | 347/215 |

FOREIGN PATENT DOCUMENTS

| | | |
|---|---|---|
| 0 095 380 | 11/1982 | European Pat. Off. . |
| 0 257 633 | 3/1988 | European Pat. Off. . |
| 62-288081 | 12/1987 | Japan . |
| 01166972 | 6/1989 | Japan . |
| 2 1 98 254 | 6/1988 | United Kingdom . |

*Primary Examiner*—N. Le
*Assistant Examiner*—Anh T. N. Vo
*Attorney, Agent, or Firm*—McCormick, Paulding & Huber LLP

[57] ABSTRACT

A process for color overprinting onto a thermally printable receiving surface includes using a thermal printer and transfer foils to print a first layer of color printing medium onto a portion of a receiving surface, and then using the thermal printer to print at least a second layer of translucent colored printing medium onto the receiving surface on top of the first layer. An index of overprint colors can be created by the process for use in matching colors printable by the overprinting process to the colors on an original graphic. The index may be used manually or in a computerized printing process to determine the number of transfer foils required to reproduce an original graphic, and their order of use.

34 Claims, 9 Drawing Sheets

METHOD AND APPARATUS FOR THERMAL TRANSFER COLOR PRINTING

CROSS REFERENCE TO RELATED APPLICATIONS

This application is a Continuation-In-Part of U.S. patent application Ser. No. 08/451,005, entitled Printer With Feed Fault Detection, filed on May 25, 1995 by Charles M. Hevenor and Martin C. Voelker, and assigned to Gerber Scientific Products, Inc. of Manchester, Conn., said application Ser. No. 451,005 being a division of U.S. patent application Ser. No. 08/007,662 filed on Jan. 22, 1993 and later abandoned, and also having issued as U.S. Pat. No. 5,661,515 on Aug. 26, 1997.

FIELD OF THE INVENTION

The present invention relates generally to color printing using thermal transfer foils, and deals more particularly with an apparatus and method for thermally overprinting one or a number of colors to produce different degrees of saturation and/or a larger number of available colors.

BACKGROUND OF THE INVENTION

The accurate reproduction of colored graphics has proven difficult using known color printing methods. This is primarily due to the fact that the methods employed to accomplish the reproductions are incapable of producing the high fidelity color and quality of the original image. One known method used to produce colored graphics employs the three process colors (cyan, magenta and yellow) to reproduce an image by first conducting a color analysis on the original and then making what are known as color separations and finally, printing the image. In the past, color separations were created by placing a red, green, and blue filter respectively over the lens of a camera and shooting a separation negative using panchromatic film (film sensitive to the visible portions of the spectrum). Use of these filters produced cyan, magenta and yellow separation negatives. Thus, these separations yielded a record of the amount and concentrations of the three process colors contained in the original. The color information contained in the negatives is then fed into a printer. The various tones and colors of the original image are approximated by printing patterns of various sized dots next to one another using each process color. When the final image is viewed, the dots tend to blend together to create what appears to be the colors corresponding to the colors found on the original image.

Historically, the dot patterns were determined using the halftone separation technique described above along with what is known as a halftone screen which was placed over the film during exposure to break up the image from the original copy into grids corresponding to the dot patterns to be printed. The dot patterns obtained from the combination of the halftone screen and the separation negatives, known as halftone dots, were then transferred to the printer which printed the patterns corresponding to each process color onto a receiving surface, thereby reproducing the original image.

More recently, the color analysis and halftone separations have been carried out in a single step using a color scanner and computer in combination with a printer. The color scanner evaluates the colored original point by point through color filters. The image is then converted from a visual to an electrical impulse that is fed into a computer. The computer then compiles this information and uses it to control a printer.

One type of printer particularly suited for printing the halftone dot patterns according to the information obtained from a scanned original is known as an ink jet printer. Typically, this type of printer uses a print head having three ink reservoirs each carrying a process colored (cyan magenta and yellow) ink. During a printing process, the print head traverses the image receiving surface and simultaneously prints the halftone dot patterns according to the color separations accomplished by the scanner and computer.

A problem often encountered with the images created by the above described process is that the patterns of dots are clearly visible. This causes the image to appear less sharp and in some cases even grainy. This is especially undesirable in situations where the images produced will be subject to close scrutiny. Accordingly, there is a need for a color image production technique which accurately reproduces an original using solid continuous colors. As used herein, the term continuous should be construed to mean that the appropriate portion of the receiving surface upon which the color is transferred is completely filled with color and contains no dots.

In addition to the foregoing, the previously described process is not capable of accurately reproducing many colors or shades of color. For instance the appearance of some subtle pastels cannot be duplicated using only the three process colors. Therefore, in some instances it may not be possible to acceptably reproduce a particular image.

A known method used to produce solid continuous colors, incorporates a thermal printer. Donor foils are utilized by the thermal printer, from which layers of color pigment are transferred to a receiving surface. The phrase "donor foil" is a term of art which denotes in one aspect, a foil or other thin material which carries a layer of pigment dispersed in a wax, resin, or wax-resin vehicle. The pigment is transferred from the foil to the receiving surface by the thermal printer through a combination of heat and pressure. Alternatively, in a second aspect, a donor foil can take the form of a dye diffusion foil or other thin material, wherein the foil or other thin material is impregnated with a transferable dye which when exposed to the heat and pressure produced by the thermal printer, diffuses out of the foil or other thin material and onto the print media. While this printing method consistently produces high quality continuous colors, it is limited by the available number of donor foil colors. The color of the dye or pigment carried by a donor foil is referred to by those skilled in the art as a "spot color." The finite number of available spot colors, has, until recently, caused this method of printing to be considered inappropriate for the accurate continuous color reproduction of images.

Based on the foregoing, there is a current need for a method of producing an expanded palette of solid continuous colors and shades of color producible from a limited number of donor foil colors. This method should be capable of producing the same high fidelity appearance on the print media, as is embodied in the original graphic. It is also important that the method employ a means of identification as well as the associated formula needed to reproduce each color and shade such that an operator is able to readily ascertain and print the desired color.

In accordance with the foregoing, it is the general object of the present invention to provide a greatly expanded palette of printable high fidelity continuous colors and shades, producible using a limited number of spot colors.

A further object of the present invention is to provide a means whereby these colors, and the formulas for their production are codified in an easily accessible fashion.

SUMMARY OF THE INVENTION

The present invention meets these and other objects by providing, in one aspect, a method for color printing onto a thermally printable receiving surface comprising printing a first layer of colored printing medium onto at least one portion of a receiving surface using a thermal printer, the colored printing medium being transferred from a pigment carrying foil to the portion of the receiving surface by localized heating of the pigment carrying foil. Subsequent to printing the first layer, a second layer of translucent colored printing medium is then printed onto the receiving surface on top of the first layer using a thermal printer. Similarly to the first layer of colored printing medium, the translucent colored printing medium of the second layer is also transferred from a pigment carrying foil to the receiving surface by localized heating of the foil. At least one of the first or second layers of colored printing medium is a continuous solid layer of printing medium throughout the portion of the receiving surface onto which it is transferred.

In a related aspect, the present invention also provides a method for color printing whereby a number of donor foils of different colors are provided. An index of available colors producible from selected combinations of the plurality of donor foils is prepared wherein each of the available colors is one obtained by thermally printing a first layer of printing medium from one of the foils onto a surface similar to the thermally printable receiving surface and then thermally printing at least a second layer of printing medium from another one of the foils over the first layer. When printing an image, the desired color to be assigned to the printed portion of the receiving surface is determined and an available color closely matching the assigned color is selected from the color index. The donor foils from which the selected available color was obtained are then used as the donor foils for thermally printing respectively the layers of printing medium onto the receiving surface.

In still another aspect of the present invention, a representation of an original graphic to be reproduced onto a receiving surface is provided. A computer is used to process the representation of the original graphic into a plurality of representations of areal fragments of the original graphic, each of which fragments is assigned a color such that the fragments, if assembled together and given their assigned colors, form a synthesized graphic closely matching the original graphic. Each of the representations of the areal fragments includes a digital representation of the color assigned to the fragment. A digital representation of each of the available colors of the index of available colors is provided, and the areal fragments are compared with both the digital representation of the color assigned to that fragment and the digital representations of the available colors. From these comparisons, a color which closely matches the assigned color is selected from the index of available colors. For each of the areal fragment representations a corresponding area of the receiving surface is printed using first and second layers of printing medium respectively from donor foils substantially identical to the donor foils from which the selected available color was obtained in the preparation of the index of available colors.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DETAILED DESCRIPTION OF THE PREFERRED EMBODIMENT

Figure 1:
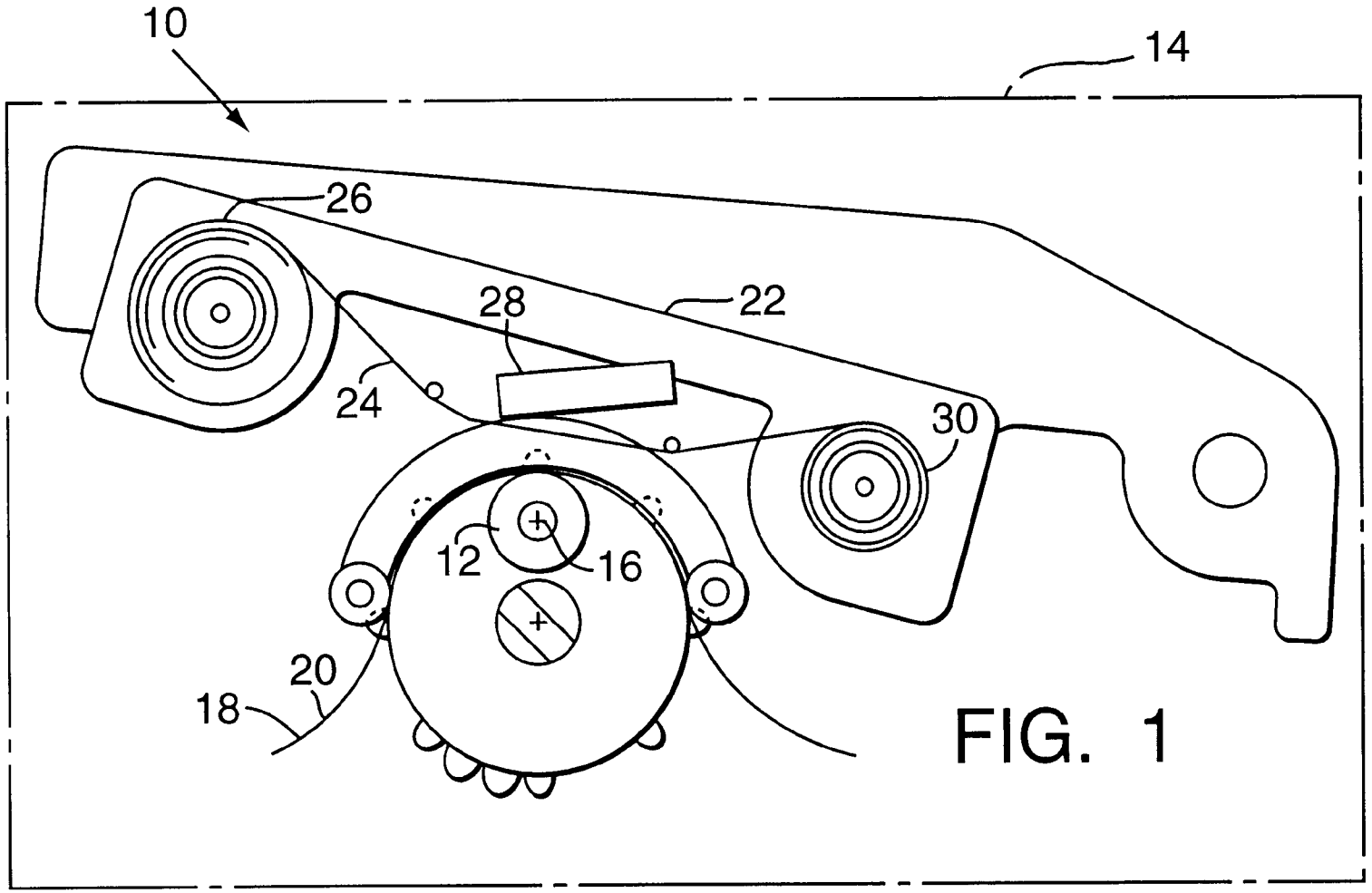
FIG. 1 is a schematic view of a thermal printer for use in the present invention.

Turning to the drawings and first referring to FIG. 1, the thermal printer generally designated as 10 and utilized in the overprinting process is illustrated schematically. The printer 10 includes a roller platen 12 mounted to a frame 14 for rotation about an axis 16. The print media 18 having a thermally printable receiving surface 20 is presented to the thermal printer 10 and is advanced over the roller platen 12 beneath a thermal print head 28 which is supported by the frame 14 above the platen. The thermal printer includes a cassette 22 having a foil 24 which carries a layer of colorants. The foil 24 extends from a supply roll 26, between the print head 28 and the roller platen 12, to a take-up roll 30 of the cassette. Thus, as the print media 18 passes over the roller platen 12 and through the thermal printer 10, the print head 28 presses down on the foil 24 bringing it into contact with the thermally printable receiving surface 20 of the print media 18. It should be understood that the foil 24 may be any suitable foil known to those skilled in the art for printing by a thermal transfer process. A donor foil found to be particularly suitable for use in the overprinting process is manufactured and sold by Gerber Scientific Products, Inc. under the trademark GerberColor.

Figure 2:
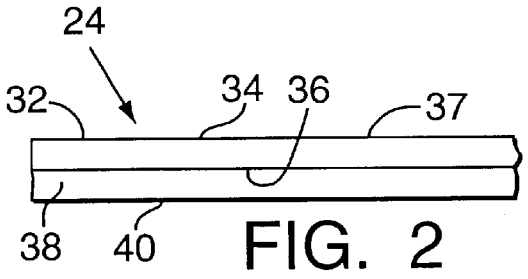
FIG. 2 is a partial view of the pigment carrying foil of the present invention.

The details of construction of the donor foil 24 are shown in FIG. 2. Referring to this figure, the donor foil includes a carrier sheet 32, made of a suitable material, such as, but not limited to, mylar or cellophane. The carrier sheet has a first upper surface 34 and a second lower opposite surface 36. A transfer layer 38 is located below the carrier sheet and is also made from a suitable material such as, but not limited to wax, lacquer, a polymeric resin or a combination thereof. A continuous color printing medium 40 is dispersed within the matrix of the transfer layer 38. A release or backcoat layer 37 is carried by the carrier sheet first upper surface 34 and acts as a lubricant thereby preventing the carrier liner from adhering to the thermal print head 28 during a printing operation. During operation, the thermal print head 28 engages the carrier sheet first upper surface 34, and through a combination of localized heat and pressure the thermal print head causes the transfer layer 38 with the color printing medium 40 dispersed therein, to melt, thereby causing the layer of color printing medium 40 to be transferred to the thermally printable receiving surface 20. Alternatively, the transfer layer could consist of a dye impregnated in the carrier layer such that during operation, the thermal print head 28 engages the carrier sheet first upper surface 34, and through a combination of localized heat and pressure the thermal print head causes the dye to diffuse out of the carrier sheet and onto the print media.

Turning to the details of the thermal overprinting process of the present invention and referring to FIGS. 1 through 4, the print media 18 is therein shown having first and second layers of colored printing medium, 42, 44 printed onto at least one portion of the thermal receiving surface 20. During the thermal overprinting process, a first print cartridge 22 carrying a donor foil 24 is loaded into the thermal printer 10. As previously described, the print media 18 is advanced through the printer 10 and the donor foil 24 is brought into communication with the thermally printable receiving surface 20 such that the print media 18 is interposed between the roller platen 16, and the donor foil 24. As the print media advances through the printer, the thermal print head 28, selectively heats localized portions of the donor foil 24 in response to commands issued from a controller, see FIG. 6, so that the first layer of color printing medium 42 is transferred to the thermally printable receiving surface 20. Upon completion of the first printing operation, the print media is returned to its starting point and a layer of translucent color printing medium 44 is printed directly over the first layer 42 using a second donor foil. The visual result of the overprinting process depends on the light absorbing and/or reflective properties of the layers of color printing medium 42 and 44. For example, if the first layer of color printing medium 42 is translucent and is overprinted onto itself, varying shades of the same color may be obtained. If the translucent layer of color printing medium 44 is a different hue than the first layer of color printing medium 42, a third hue will be produced by overprinting the second layer of color printing medium onto the first. Additionally, the layers of color printing medium may have holographic, prismatic, metallic, pearlescent, fluorescent, glossy, matte, or other characteristics. In other words, the present invention should be broadly construed to include printing mediums which reflect or absorb light to produce various visual effects.

In addition to the foregoing, the reflective properties of the thermally printable receiving surface 14 can also dramatically effect the appearance of the final graphical image. As such, the thermally printable receiving surface 14 of the present invention must be made of a suitable material, such as, but not limited to, vinyl or mylar. Moreover, the print media 12 may be holographic, prismatic, pearlescent, metallic, fluorescent, or display other light reflective characteristics.

Figure 3:
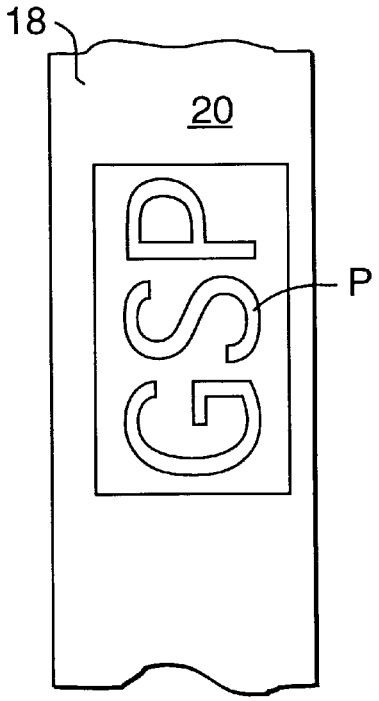
FIG. 3 is a partial view of the print media of the present invention.
Figure 4:
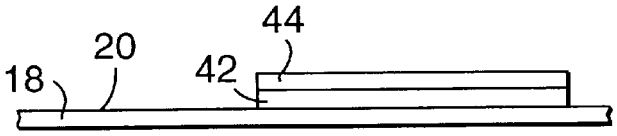
FIG. 4 is a side elevation of the print media of the present invention showing the overprinted layers of color printing medium.

Referring next to FIG. 3, either of the first or second layers of color printing media 42, 44 printed onto the thermally printable receiving surface 14 may be in the form of a color gradient consisting of a pattern of colored dots such that when overprinted with another translucent printing medium the appearance of a continuous color gradient will be created.

Figure 5:
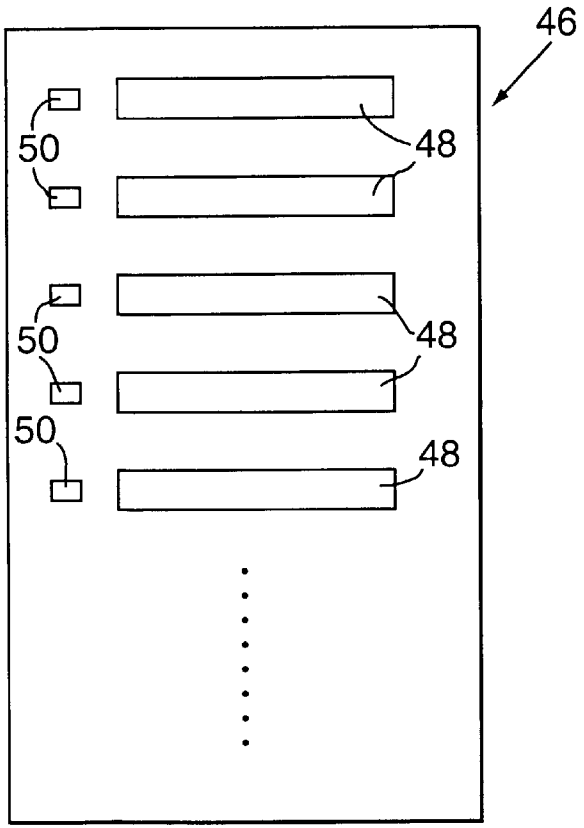
FIG. 5 is a simplified schematic of the reference color index of the present invention.

Having established the method by which thermal overprinting is accomplished, the present invention is also directed to a color indexing device created by thermal overprinting using spot colors. As previously defined, spot colors comprise the colors carried by donor foils. By overprinting different combinations of spot colors, a wide palette of different hues and shades can be created using a relatively small number of donor foils. A color index 46 of the type referred to is shown in FIG. 5 and consists of a plurality of reference colors 48 produced from a plurality of donor foils wherein each of the reference colors 48 is created by thermally printing a first layer of printing medium from one of the foils onto a surface similar to a portion of the thermally printable receiving surface 20 and then thermally overprinting a second layer of printing medium from another one of the foils over the first layer. Preferably, the reference colors 48 are arranged on the color reference index in groups identifiable with reference to particular selections and combinations of spot and process colors. Since the visual appearance of the reference colors can vary with different surface textures, the reference colors can also be printed onto a plurality of different materials having different surface qualities. The color reference index includes, or is associated with, means to identify the various reference colors 50. These identifying means can consist of, but are not limited to, reference color code numbers tied to particular reference color formulas which identify the donor foil combinations and the order of use needed to produce the particular reference color. It should be noted that the reference color index 46 can consist of a plurality of several individual charts each containing a plurality of reference colors.

The reference color index 46 can be used in several different overprinting processes. In one such process the operator of a thermal printer determines a desired color to be assigned to a portion of the thermal receiving surface 20 of the print media 18. Using the color reference chart, the operator selects an available color closely matching the assigned color. Referring to the reference color identifying means 50, the operator determines which colored donor foils are needed to print the desired color and their order of application. Then, using these donor foils, the operator thermally prints the first and second layers of printing medium onto a portion of the receiving surface.

Figure 7:
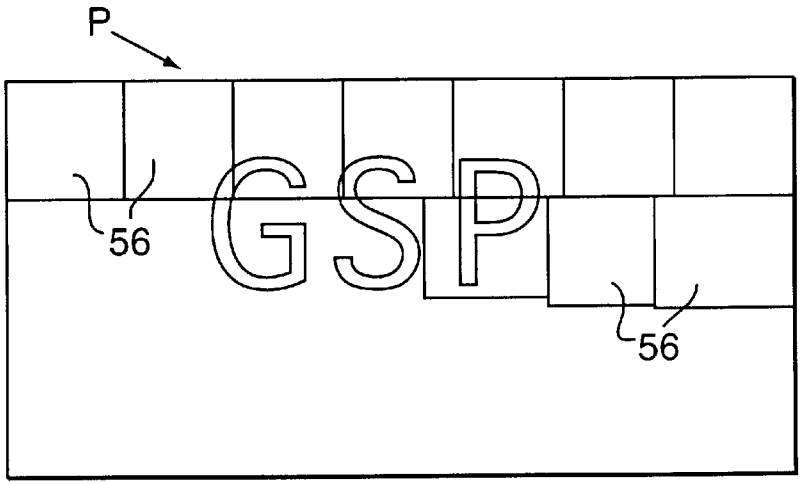
FIG. 7 is a simplified schematic showing a graphic broken down into areal fragments.
Figure 6:
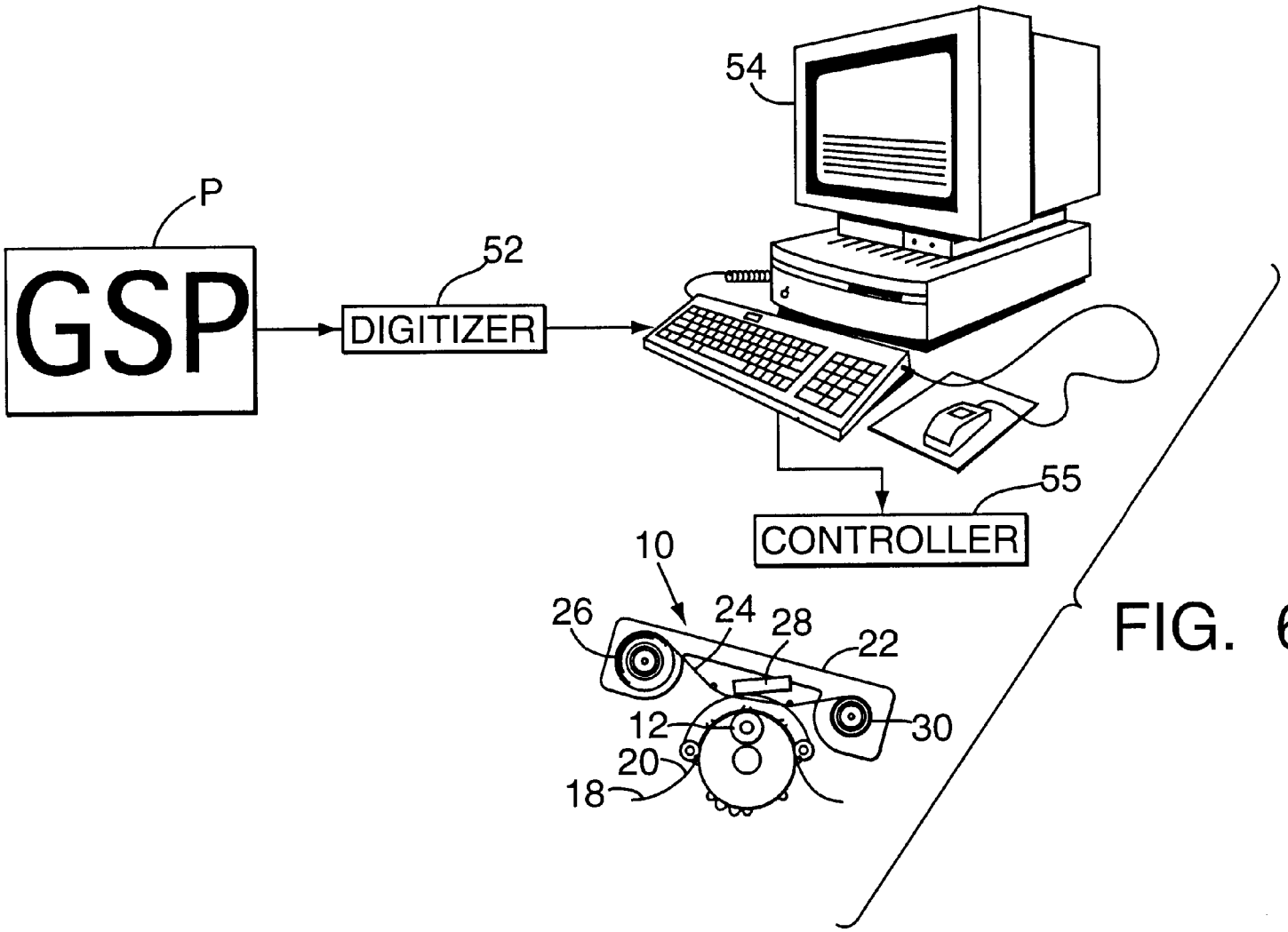
FIG. 6 is a schematic view of an apparatus for thermally overprinting the print media of the present invention.
Figure 8:
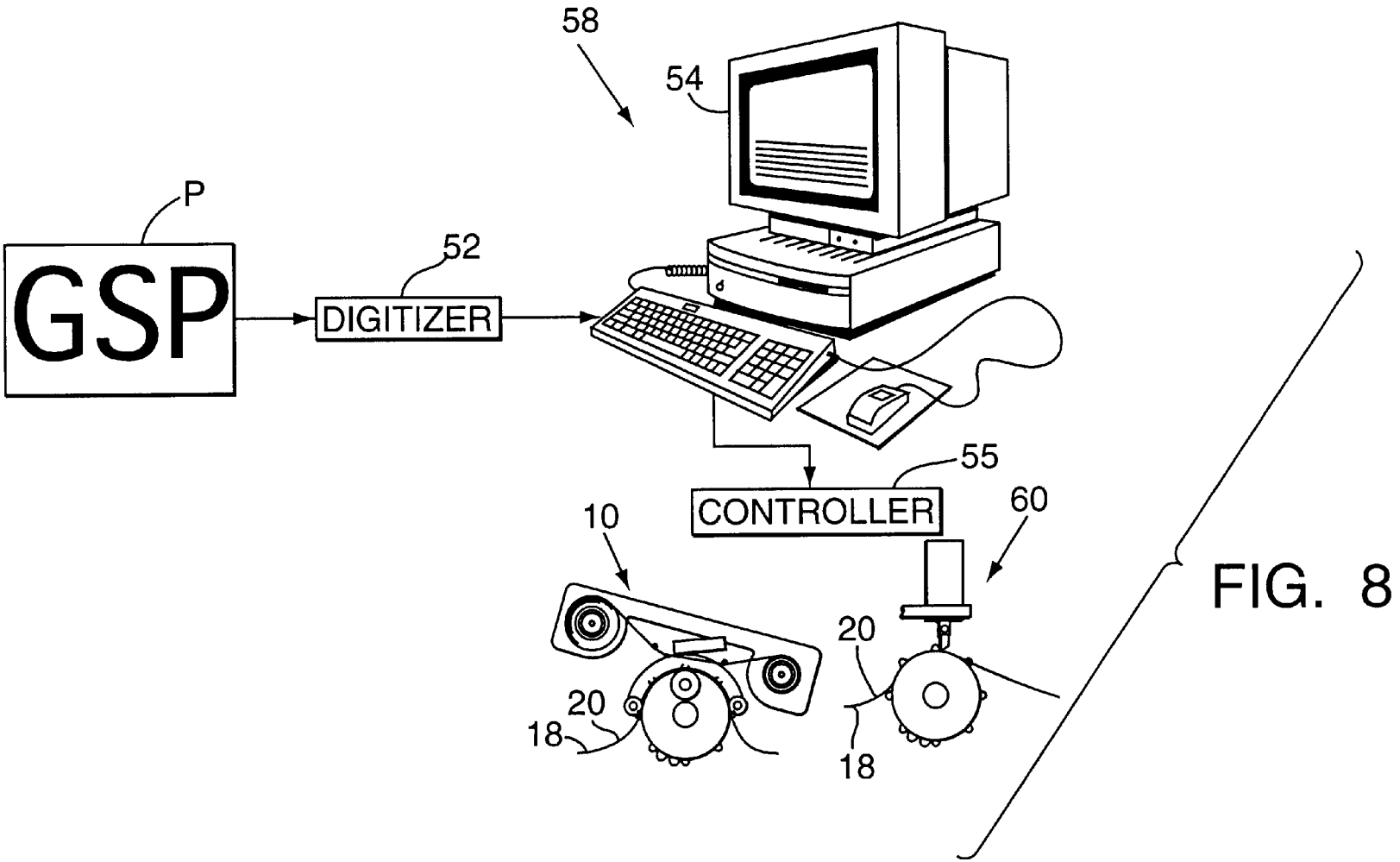
FIG. 8 is a schematic view of an apparatus for thermally overprinting and cutting a print media.
Figure 9:
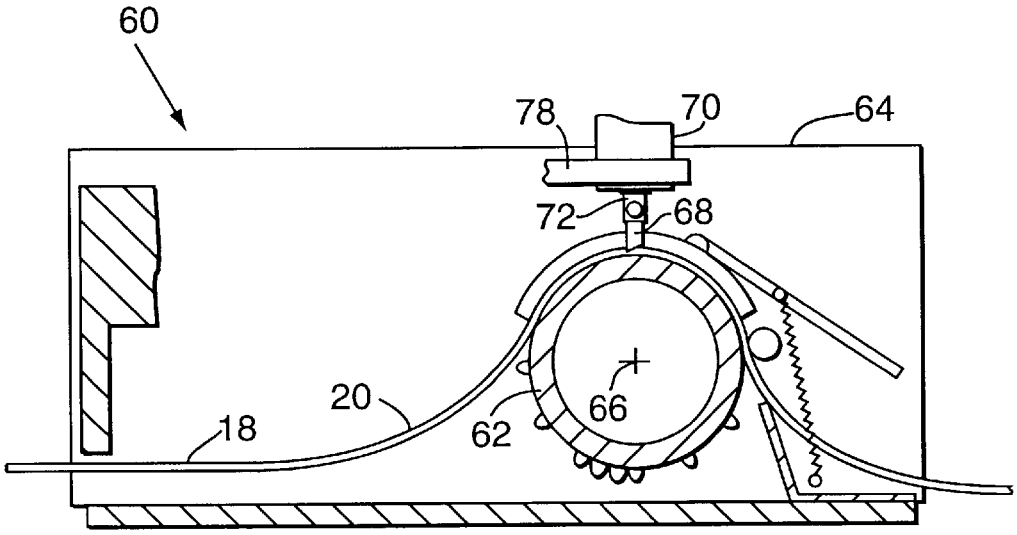
FIG. 9 is a fragmentary sectional view of the cutting device which forms part of the apparatus of FIG. 8.
Figure 10:
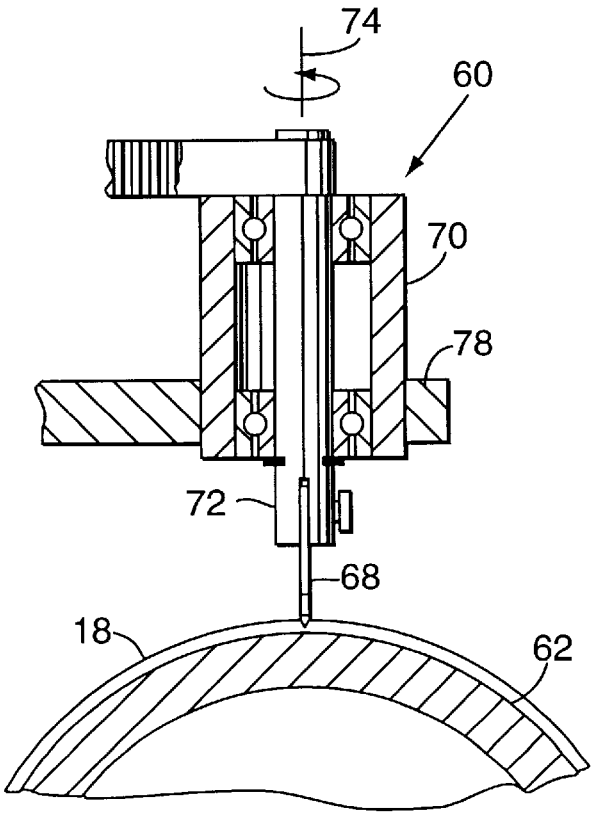
FIG. 10 is an enlarged fragmentary sectional view of the cutting device which forms part of the apparatus of FIG. 8.

In addition to the aforementioned, the color reference index can also be used in conjunction with the reproduction of a representative graphic in a process known to those skilled in the art as posterizing. Referring to FIG. 6, a graphic P is processed using a digitizer 52 or other data input device which supplies a computer 54 with machine readable data defining the graphic to be printed. The representation of the original graphic is broken down by the computer into a plurality of representations of areal fragments 56, FIG. 7, of the original graphic. Each of the areal fragments is assigned a color such that the fragments, if assembled together and given their assigned colors, would form a synthesized graphic closely matching the original graphic. The representations of the areal fragments each include a digital representation of the color assigned to the fragment. The computer 54 is provided with a computer readable medium encoded with a computer program corresponding to digital representations of each of the available reference colors obtained from the index of available colors. The computer then compares the digital representations of the colors assigned to the graphic with the digital representation of the available reference colors and from this comparison a color is selected from the index of available reference colors which provides the closest match to the color assigned to the graphic. Subsequent to the color selection, the operator selects the donor foils required to reproduce the graphic and then for each of the areal fragments thermally prints onto a corresponding area of the receiving surface, the layers of printing medium using donor foils substantially identical to the donor foils from which the selected available reference color was obtained in the preparation of the index of available reference colors.

In an alternate embodiment of the previously described posterizing process, in addition to selecting the appropriate reference colors, the computer also determines the optimal combination of donor foils required, and the order of their use to efficiently reproduce the desired graphic in as few steps and using as few donor foils as possible.

In yet another aspect of the present invention, and with reference to FIGS. 8–11, a preferred embodiment of an apparatus there shown and generally designated as 58, is used for overprinting and cutting a graphic, such as the illustrated graphic P, on a strip of print media 18 having a thermal receiving surface 20. As described above the graphic P is printed using the thermal overprint process. Subsequent to the thermal overprinting process, a selected portion of the print media including the graphic is then cut from the thermal receiving surface 20 by cutting means 60 in response to commands issued from the controller 55, FIG. 6. During the cutting operation, only the thermal receiving surface 20 is cut through, while the remainder of the print media 18 remains intact. The cutting device 60 includes a roller platen 62 rotatably mounted to a frame 64 for rotation about an axis 66. In operation, the print media passes over the roller platen 62 relative to a cutting tool 68. The cutting device 60 is further defined by a tool head 70 and an associated tool holder 72 rotatably mounted to the tool head 70. A cutting tool herein shown as, but not limited to, a blade 68 is received in the tool holder and rotatable relative to the tool head 70 about an axis 74.

Figure 11:
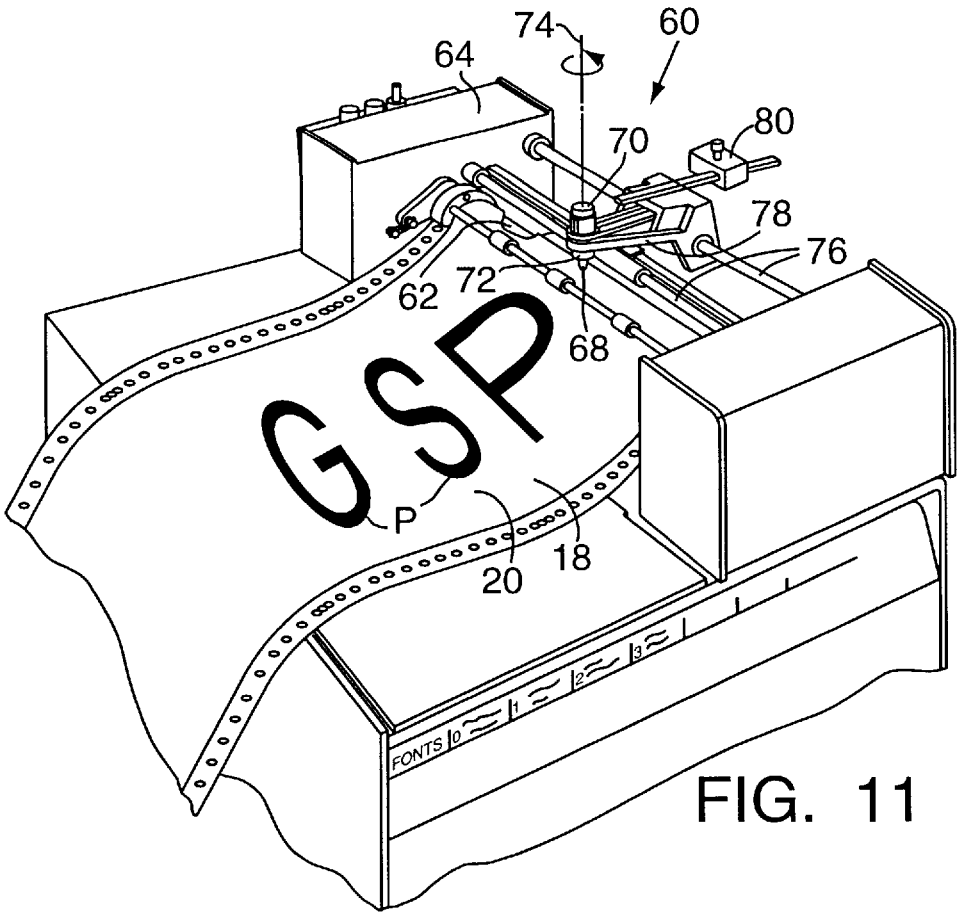
FIG. 11 is a perspective view of the cutting device which forms a part of the apparatus shown in FIG. 8.

As can best be seen in FIG. 11, the cutting device 60 is oriented substantially vertically when the cutting tool 68 is in the working position above the print media 18. The cutting device 60 is pivotally and slidably mounted on ways 76 which are fixed to frame 64, such that during the cutting operation, as the print media 18 is advanced, the tool holder 72 can traverse the width of the print media 18.

The cutting device 60 is cantilevered outwardly from the ways 76 on an arm 78 allowing the tool holder 72 and associated cutting tool 68 to be urged downwardly toward the print media 18. The cutting device 60 may include a variably positionable first counterweight 80 mounted to the cutting device 60 so as to vary the amount of downward pressure applied to the print media 18 or alternatively may include a mechanical device having a variable tensioning spring mechanism for applying discreet amounts of downward force to the print media 18 through the tool holder 72. Thus, the pressure of the first cutting tool 68 on the print media 18 during the cutting operation is controllable by such means as the counterweight 80 so that the depth of penetration of the cutting tool 68 can be adjusted and held at a substantially constant value. The maximum depth of penetration is such that during the cutting process, the print media 18 is cut through the thermally printable receiving surface 20 only and not through the full extent of the print media's thickness.

Figure 13:
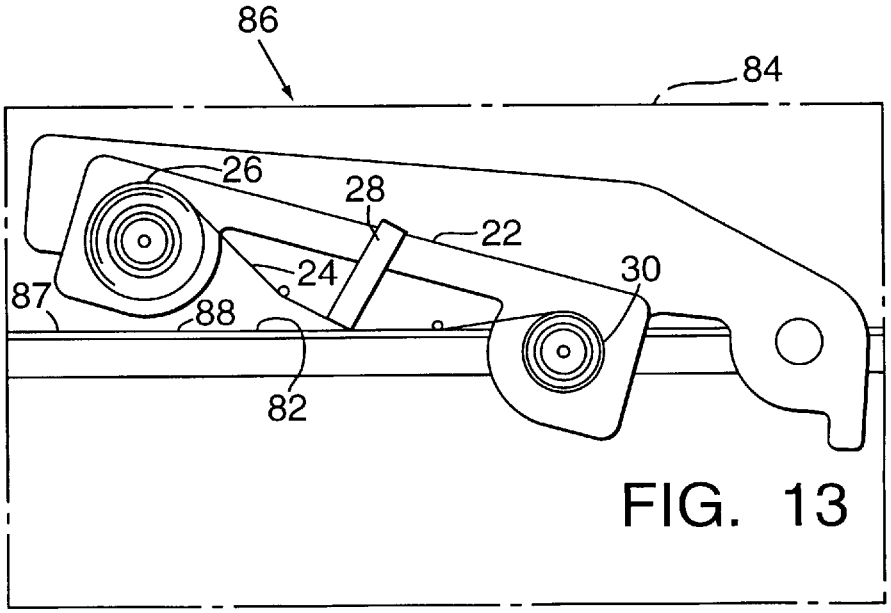
FIG. 13 is a partial view of the thermal printer of the embodiment shown in FIG. 12.
Figure 12:
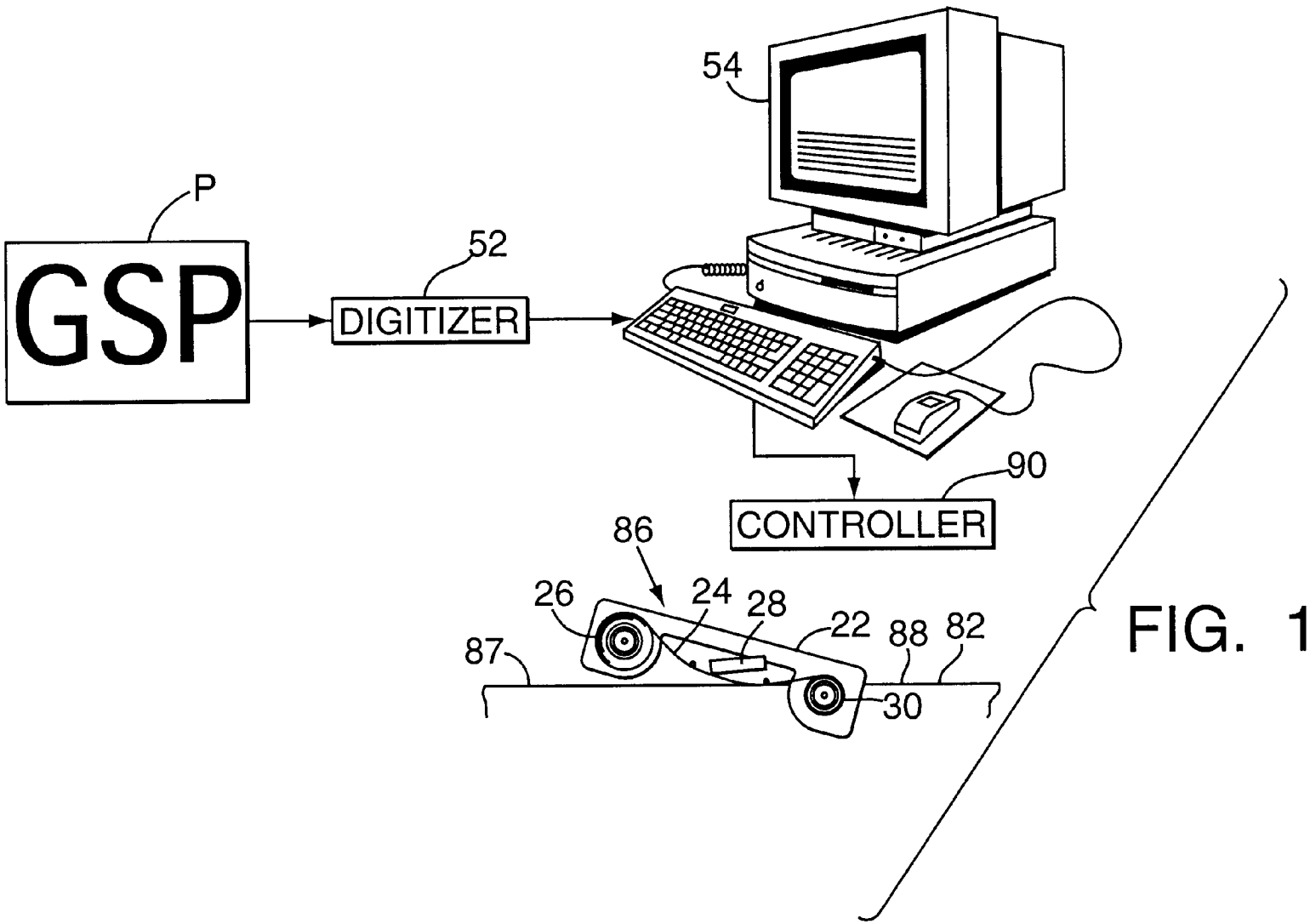
FIG. 12 is a schematic view of an alternate embodiment of the apparatus of the present invention for thermally overprinting a sheet of print media.

In still another embodiment of the present invention shown in FIGS. 12 and 13, the thermal printer includes a flat work surface 82 mounted to a frame 84. The thermal printer 86 is slidably mounted to the frame 84 such that it can traverse the width of the print media 86 being processed. The print media 87 has a thermally printable receiving surface 88 and is interposed between the work surface 82 and the thermal printer 86 with the thermally printable receiving surface 88 facing the thermal printer. Similarly to the device shown in FIGS. 8–11, a controller 90 is in communication with the thermal printer 86 for controlling its movement.

Figure 14:
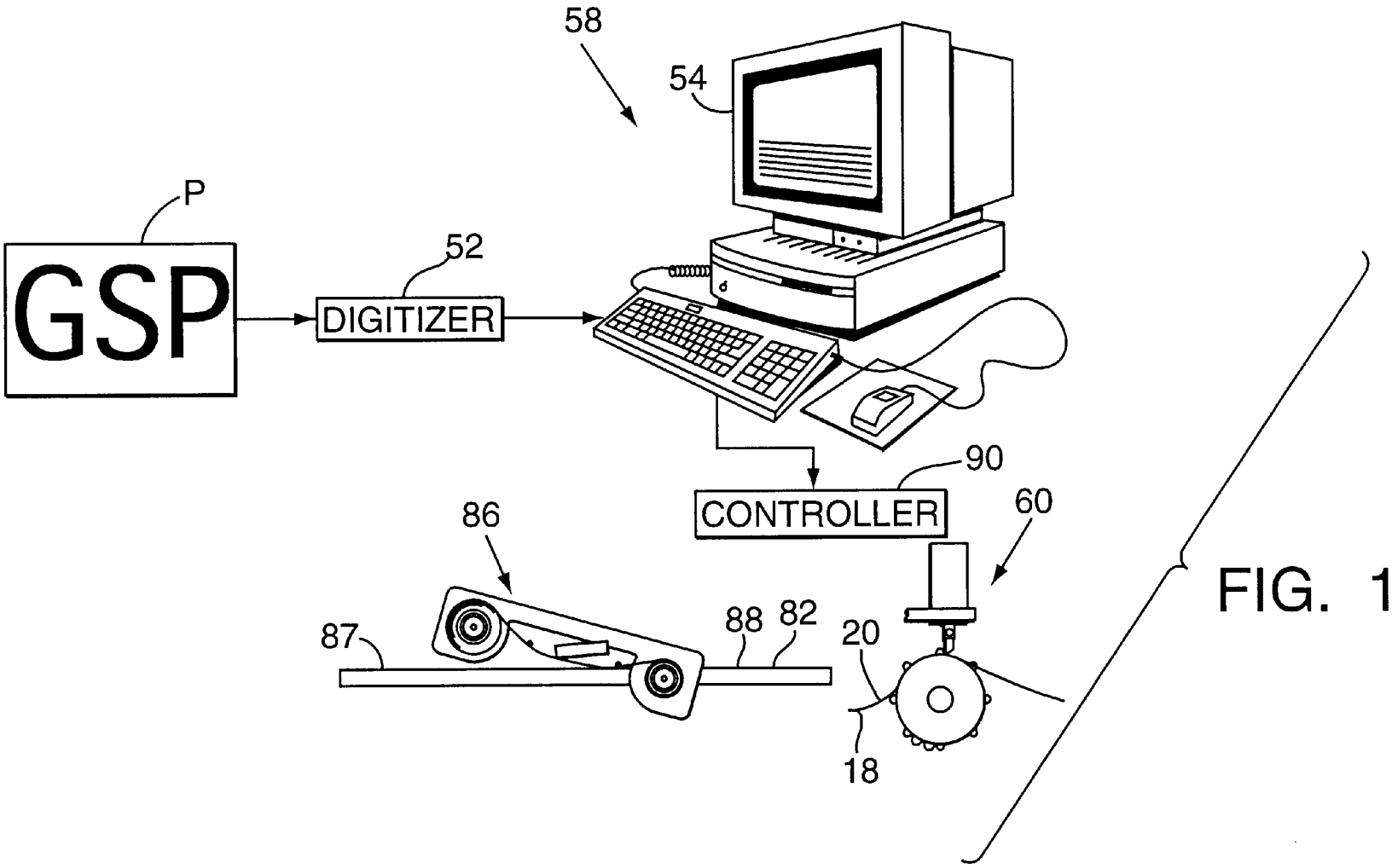
FIG. 14 is a schematic view of an alternate system for thermally overprinting and cutting a print media.

Referring to FIG. 14, the alternate embodiment of FIGS. 12 and 13, further includes a cutting device 60. Cutting device 60 is the same cutting device 60 shown in FIGS. 9 through 11 and described above. Therefore, subsequent to the thermal overprinting process, a selected portion of the print media including the graphic can be cut from the thermal receiving surface 88 by cutting means 60 in response to commands issued from the controller 90, FIG. 12. During the cutting operation, only the thermal receiving surface 88 is cut through, while the remainder of the print media 86 remains intact.

While the overprint process has been described herein as involving the thermal printing of only a first and second layer of color printing medium, the invention should not be limited in this regard as it is possible to overprint several layers of color printing media to achieve various colors, shades, and effects.

While preferred embodiments have been shown and described, various modifications and substitutions may be made without departing from the spirit and scope of the present invention. Accordingly, it is to be understood that the present invention has been described by way of example and not by limitation.

We claim:

1. A process for color printing onto a thermally printable receiving surface, said process comprising:

printing a first layer of colored printing medium onto at least one portion of said receiving surface using a thermal printer having a thermal print head whereby said colored printing medium is transferred from a pigment carrying foil to said portion of said receiving surface by causing said thermal print head to engage and locally heat a portion of said pigment carrying foil, and printing at least a second layer of colored printing medium onto said one portion of said receiving surface on top of said first layer using a thermal printer having a thermal print head whereby said second layer of colored printing medium is transferred from the same or another pigment carrying foil to said portion of said receiving surface by localized heating of said pigment carrying foil, at least one of said first and second layers of colored printing medium being a continuous solid layer of printing medium along said one portion of said receiving surface onto which it is transferred.

2. The process of claim 1 wherein the printing at least a second layer of translucent colored printing medium onto said one portion of said receiving surface further includes printing a plurality of layers of colored printing medium onto said one portion of said receiving surface.

3. The process for color printing as defined in claim 1, wherein said printing medium of said first layer is translucent.

4. The process for color printing as defined in claim 1, wherein said printing medium of said first layer is an opaque printing medium.

5. The process for color printing as defined in claim 1, wherein said printing medium of said first layer and said printing medium of said second layer are of different colors.

6. The process for color printing as defined in claim 1, wherein said printing medium of said first layer and said printing medium of said second layer are of the same color.

7. The process for color printing as defined in claim 1, wherein both of said first and second layers of colored printing medium are continuous throughout said one portion of said receiving surface.

8. The process for color printing as defined in claim 1, wherein one of said first and second layers of colored printing medium is a layer comprised of a plurality of dots of printing medium distributed over said one portion of said receiving surface.

9. The process for color printing as defined in claim 8, wherein said plurality of dots of printing medium are all of said dots the same color.

10. The process for color printing as defined in claim 8, wherein said plurality of dots of printing medium are of different colors.

11. The process for color printing as defined in claim 1, wherein each of said first and second layers of printing medium are provided as continuous colors.

12. The process for color printing as defined in claim 1, wherein one of said first and second layers of printing medium is provided as a spot color and the other of said first and second layers of printing medium is a process color made up of a plurality of dots.

13. The process for color printing as defined in claim 12, wherein said process color layer of printing medium is said first layer of printing medium and said spot color layer of printing medium is said second layer of printing medium.

14. The process for color printing as defined in claim 12, wherein said spot color layer of printing medium is said first layer of printing medium and said process color layer of printing medium is said second layer of printing medium.

15. The process for color printing as defined in claim 1, wherein said thermally printable receiving surface is a vinyl material.

16. The process for color printing as defined in claim 1, wherein said thermally printable receiving surface is a mylar material.

17. The process for color printing as defined in claim 1, wherein said one portion of said receiving surface is of white color.

18. The process for color printing as defined in claim 1, wherein:

said printing said first layer of colored printing medium is carried out using said pigment carrying foil comprising a sheet of carrier material having a release layer adhered to an upper surface of said carrier material and a layer of printing medium adhered to a lower surface of said carrier material, said layer of printing medium comprising said pigment dispersed in a matrix of meltable polymer material, and printing said at least a second layer of printing medium is carried out using said pigment carrying foil comprising a sheet of carrier material having a release layer adhered to an upper surface of said carrier material and a layer of printing medium adhered to a lower surface of said carrier material, said layer of printing medium comprising said pigment dispersed in a matrix of meatball polymer material.

19. The process for color printing as defined in claim 1, wherein:

said printing said first layer of colored printing medium is carried out using said pigment carrying foil comprising a sheet of carrier material having a release layer adhered to an upper surface of said carrier material and wherein said pigment is a dye impregnated into said sheet of carrier material; and printing said at least a second layer of printing medium is carried out using said pigment carrying foil comprising a sheet of carrier material having a release layer adhered to an upper surface of said carrier material and wherein said pigment is a dye impregnated into said sheet of carrier material.

20. The process for color printing defined in claim 1 further including the steps of:

providing a plurality of donor foils, each carrying a printing media of different colors from foil to foil, generating an index of colors printable from said plurality of donor foils by printing a first layer of printing medium from one of said foils onto a surface similar to said one portion of said thermally printable receiving surface and then thermally printing at least a second layer of printing medium from another one of said foils over said first layer, choosing a color to be assigned to said one portion of said receiving surface, selecting from said color index of available colors an available color closely matching said assigned color, and using the donor foils from which the selected available color was obtained as the donor foils for thermally printing respectively said first and at least a second layers of printing medium onto said one portion of said receiving surface.

21. The process for color printing as defined in claim 20 and applied to the printing of a graphic onto said thermally printable receiving surface which graphic has areal portions of different colors, and further including the steps of:

providing a representation of an original graphic to be reproduced onto said receiving surface, computer processing said representation of said original graphic into a plurality of representations of areal fragments of said original graphic to each of which fragments is assigned a color such that said fragments, if assembled together and given their assigned colors, form a synthesized graphic closely matching said original graphic, said representations of said areal fragments each including a digital representation of the color assigned to the fragment, providing a digital representation of each of said colors of said index of colors;

for each of said representations of areal fragments comparing the digital representation of the assigned color assigned to that fragment with the digital representations of said colors of said index of colors and from said comparisons selecting from said index of colors a color which most closely matches the assigned color, and then for each of said areal fragment representations printing onto a corresponding area of said receiving surface said first and second layers of printing medium using respectively for said layers donor foils substantially identical to the donor foils from which the selected available color was obtained in the preparation of said index of available colors.

22. The process for color printing as defined in claim 21 and applied to the printing of a graphic onto said thermally printable receiving surface which graphic has areal portions of different colors, and further including the steps of:

using said computer processor to compare the digital representation of the assigned color assigned to that fragment with the digital representations of said colors of said index and from said comparisons selecting via said computer processor from said index of colors a color which most closely matches the assigned color, and using said computer processor to determine the optimal combination of said donor foils required, and the optimal order of their use to most efficiently produce said representation of said original graphic in as few steps as possible.

23. The process for color printing as defined in claim 1, wherein said printing medium of said first layer is a metallic printing medium.

24. The process for color printing as defined in claim 1, wherein said printing medium of said first layer is a holographic printing medium.

25. The process for color printing as defined in claim 1, wherein said printing medium of said first layer is a pearlescent printing medium.

26. The process for color printing as defined in claim 1, wherein said printing medium of said first layer is a fluorescent printing medium.

27. The process for color printing as defined in claim 1, wherein said printing medium of said first layer is a glossy finish printing medium.

28. The process for color printing as defined in claim 1, wherein said printing medium of said first layer is a matte finish printing medium.

29. An apparatus for thermally overprinting a graphic onto a thermally printable receiving surface comprising:

a sheet of print media having said thermally printable receiving surface;

a thermal printer having a roller rotatably mounted to a frame over which said sheet of print media passes;

a print cartridge containing a pigment carrying foil positioned in said thermal printer above said roller;

said print media being interposed between said roller and said print cartridge with said thermally printable receiving surface facing said print cartridge;

an overprint color index for providing a list of colors producable using a combination of print cartridges associated with said thermal printer from which an operator selects one or more print cartridges corresponding to the colors needed to produce a particular graphic by thermal overprinting; and a controller in communication with said thermal printer for issuing command signals thereto corresponding to a graphic to be printed.

30. The apparatus of claim 29 further comprising:

a cutting means for cutting said sheet of print media having said graphic printed thereon.

31. The apparatus of claim 29 further comprising:

a computer processor in communication with said controller, and having a memory means for storing said data therein, and wherein;

said overprint color index and data corresponding to said graphic are stored in said memory means such that said stored graphic is compared internally within said computer processor to said overprint color index to provide a listing of said cartridges required and an order of use of said cartridges.

32. An apparatus for thermally overprinting a graphic onto a thermally printable receiving surface comprising:

a sheet of print media having said thermally printable receiving surface a flat bed thermal printing means having a work surface mounted to a frame upon which said sheet of print media is positioned;

a print cartridge containing a pigment carrying foil positioned in said thermal printing means above said work surface;

said print media being interposed between said work surface and said print cartridge with said thermally printable receiving surface facing said print cartridge;

an overprint color index in communication with said thermal print means to assist an operator in selecting the print cartridges corresponding to the colors needed to produce a particular; and a controller for storing data corresponding to said graphic in machine readable format, said controller being in communication with said thermal printer for issuing command signals thereto corresponding to said graphic to be printed.

33. The apparatus of claim 32 further comprising:

a cutting means cutting said sheet of print media having said graphic printed thereon.

34. The apparatus of claim 32 further comprising:

a computer processor in communication with said controller, and having a memory means for storing said data therein, and wherein;

said overprint color index and said graphic are stored in said memory means such that said stored graphic is compared internally within said computer processor to said overprint color index to provide a listing of said cartridges required and an order of use of said cartridges.

* * * * *

UNITED STATES PATENT AND TRADEMARK OFFICE

CERTIFICATE OF CORRECTION

PATENT NO. : 6,002,416

DATED : December 14, 1999

INVENTOR(S) : Gerber et al.

It is certified that error appears in the above-identified patent and that said Letters Patent is hereby corrected as shown below:

On the Title page, under Inventors: Add --Charles M. Hevenor, Glastonbury, CT--.

Signed and Sealed this

Eighth Day of August, 2000

*Attest:*

*Attesting Officer*

Q. TODD DICKINSON

*Director of Patents and Trademarks*